US011168523B2

(12) United States Patent
McClure et al.

(10) Patent No.: US 11,168,523 B2
(45) Date of Patent: Nov. 9, 2021

(54) ROTARY STEERABLE DRILL STRING

(71) Applicant: SHELL OIL COMPANY, Houston, TX (US)

(72) Inventors: Paul Anthony Donegan McClure, Aberdeen (GB); Jan-Jette Blangé, Rijswijk (NL); Sergey Sotskiy, Houston, TX (US)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 16/623,920

(22) PCT Filed: Jun. 28, 2018

(86) PCT No.: PCT/EP2018/067356
§ 371 (c)(1),
(2) Date: Dec. 18, 2019

(87) PCT Pub. No.: WO2019/002436
PCT Pub. Date: Jan. 3, 2019

(65) Prior Publication Data

US 2020/0131852 A1 Apr. 30, 2020

(30) Foreign Application Priority Data

Jun. 30, 2017 (EP) ..... 17179027

(51) Int. Cl.
*E21B 7/06* (2006.01)
*E21B 10/61* (2006.01)
(Continued)

(52) U.S. Cl.
CPC ..... *E21B 7/064* (2013.01); *E21B 10/602* (2013.01); *E21B 10/61* (2013.01); *E21B 17/18* (2013.01); *E21B 10/55* (2013.01)

(58) Field of Classification Search
CPC ..... E21B 7/064; E21B 10/602; E21B 10/61; E21B 10/55; E21B 17/18
See application file for complete search history.

(56) References Cited

U.S. PATENT DOCUMENTS 4,836,301 A * 6/1989 Van Dongen ..... E21B 7/065 175/256
9,617,794 B2 4/2017 Durairajan et al.
(Continued)

FOREIGN PATENT DOCUMENTS

GB 2419202 A 4/2006

OTHER PUBLICATIONS

International Search Report and Written Opinion received for PCT Patent Application No. PCT/EP2018/067356, dated Aug. 3, 2018, 14 pages.

*Primary Examiner* — Nicole Coy
*Assistant Examiner* — Yanick A Akaragwe
(74) *Attorney, Agent, or Firm* — Shell Oil Company

(57) ABSTRACT

A rotary steerable drill string (16) employs a drill bit (10) selected to positively contribute to underpressure in a pre-selected azimuthal segment of the borehole relative to an opposing azimuthal section. Generally, a high flow velocity of drilling fluid in the selected azimuthal segment relative to in other segments will result in a more pronounced under-pressure in the selected azimuthal segment. Drill bit designs which locally enhance the drilling fluid flow velocity are proposed to be employed in the present rotary steerable drill string.

18 Claims, 2 Drawing Sheets

(51) Int. Cl.

| | |
|---|---|
| ***E21B 10/60*** | (2006.01) |
| ***E21B 17/18*** | (2006.01) |
| *E21B 10/55* | (2006.01) |

(56) References Cited

U.S. PATENT DOCUMENTS

| | | | | |
|---|---|---|---|---|
| 2011/0031029 | A1* | 2/2011 | Gavia | E21B 10/43 175/428 |
| 2013/0068525 | A1* | 3/2013 | DiGiovanni | E21B 47/06 175/40 |
| 2013/0292181 | A1 | 11/2013 | Blange et al. | |
| 2013/0292186 | A1 | 11/2013 | Zhang et al. | |
| 2016/0061019 | A1 | 3/2016 | Blange et al. | |
| 2016/0076305 | A1 | 3/2016 | Blange et al. | |
| 2016/0084011 | A1 | 3/2016 | Blange et al. | |

* cited by examiner

ROTARY STEERABLE DRILL STRING

CROSS REFERENCE TO RELATED APPLICATIONS

This is a National stage application of International application No. PCT/EP2018/067356, filed 28 Jun. 2018, which claims priority of European application No. 17179027.2 filed 30 Jun. 2017.

FIELD OF THE INVENTION

In one aspect, the present invention relates to a rotary steerable drill string for directional drilling a borehole in an earth formation.

BACKGROUND OF THE INVENTION

There is a significant interest in the oil and gas drilling industry in rotary steerable drilling systems that allow for directional drilling. Various systems and concepts have been developed to accomplish directional drilling.

US patent application publication US 2016/0084011 A1 describes systems and methods that accomplish deviated drilling by diverting circulating drilling fluid in a geostationary manner within the drill string, to selectively provide more drilling fluid to drilling fluid nozzles at a selected azimuthal segment around a predetermined geostationary azimuth compared to other drilling fluid nozzles that are not in said selected azimuthal segment. In such systems and methods, a drill string rotates in an azimuthal direction about a drill string longitudinal axis. A drill bit is connected to a lower end of the drill string in a rotation-locked configuration to rotate in unison with the drill string about the drill string longitudinal axis. Drilling fluid is circulated from an upper end of the drill string to the lower end of the drill string via a drilling fluid passage within the drill string, whereby a flow diverter is configured in a lower end of the drill string in the drilling fluid passage, which flow diverter is configured rotatable about the drill string longitudinal axis relative to the drill string. The flow diverter can direct the drilling fluid from the drilling fluid passage into an azimuth segment which is stationary relative to the flow diverter. As a result, the drilling fluid is expelled more through the nozzle(s) that by rotation of the drill string and drill bit move through the azimuth segment than through nozzles that are on an opposing side. This creates an underpressure resulting in a curve in the trajectory of the borehole being drilled. For drilling in a straight direction, the flow diverter can be allowed to rotate relative to the surrounding formation, and thus flush each side of the borehole.

SUMMARY OF THE INVENTION

The invention provides rotary steerable drill string, comprising:

a drill string rotatable in an azimuthal direction about a drill string longitudinal axis;

a drill bit connected to a lower end of the drill string in a rotation-locked configuration to rotate in unison with the drill string about the drill string longitudinal axis;

a drilling fluid passage within the drill string, to pass a drilling fluid from an upper end of the drill string to the lower end of the drill string via the drilling fluid passage;

a flow diverter configured in a lower end of the drill string in the drilling fluid passage, which flow diverter is configured rotatable about the drill string longitudinal axis relative to the drill string, to preferentially direct the drilling fluid from the drilling fluid passage into an azimuth segment which is stationary relative to the flow diverter. The drill bit has a base surface facing in a down-facing direction along the longitudinal axis, and a barrel surface circumferencing the longitudinal axis and facing radially outward perpendicular to the longitudinal axis. The drill bit further comprises at least two main blades protruding from the base surface and from the barrel surface, each of the two main blades having a leading face facing the azimuthal rotation direction and a trailing face looking away from the azimuthal rotation direction and an outer blade surface bridging the leading face and the trailing face, and a plurality of fixed cutter elements mounted on at least the leading face of each of the two main blades. Each sector of the bit face defined by and bound between two adjacent main blades is provided with at least one drilling fluid nozzle which co-rotates with the drill bit.

The drill bit may have a fully closed center at the intersection of bit face and the longitudinal axis, wherein the at least two main blades contact each other, whereby the leading face of one of the two main blades converges with the trailing face of another of the at least two main blades and the trailing face of said one of the two main blades converges with the leading face of said other of the at least two main blades.

Alternatively, or in addition thereof, at least one junk slot is provided on the barrel surface to provide a flow channel having an effective aperture for upward flow of drilling fluid that has been expelled from the at least one nozzle, which effective aperture decreases along the upward flow direction of the drilling fluid. Effective aperture means the cross sectional area of the window perpendicular to the flow direction which is available for drilling fluid to flow through. This may be accomplished, for instance, by converging the width of the flow channel and/or by reducing the depth of the flow channel when considered at successive locations along the upward flow direction by employing a slightly conical barrel surface which is outwardly tapered (i.e. the outer diameter of the barrel surface increases along an upward direction).

BRIEF DESCRIPTION OF THE DRAWING

The appended drawing, which is non-limiting, comprises the following figures.

DETAILED DESCRIPTION OF THE INVENTION

The invention will be further illustrated hereinafter by way of example only, and with reference to the non-limiting drawing. The person skilled in the art will readily understand that, while the invention is illustrated making reference to one or more specific combinations of features and measures, many of those features and measures are functionally independent from other features and measures such that they can be equally or similarly applied independently in other embodiments or combinations.

The presently proposed rotary steerable drill string employs a drill bit selected to positively contribute to underpressure in preselected azimuthal segment of the borehole relative to an opposing azimuthal section. Generally, a high flow velocity of drilling fluid in the selected azimuthal segment relative to in other segments will result in a more pronounced underpressure in the selected azimuthal segment. Drill bit designs which locally enhance the drilling fluid flow velocity are proposed to be employed in the present rotary steerable drill string.

For example, the drill bit may have a fully closed center at the intersection of bit face and the longitudinal axis, wherein the at least two main blades contact each other, whereby the leading face of one of the two main blades converges with the trailing face of another of the at least two main blades and the trailing face of said one of the two main blades converges with the leading face of said other of the at least two main blades. Herewith, cross-over of drilling fluid being expelled from a drilling fluid nozzle in one sector of the bit face defined by and bound between two adjacent main blades to other sectors of the bit face is obstructed, causing a higher flow velocity in the sector.

In another example, which may be implemented independently or in combination with the previous example, the effective aperture for upward flow of drilling fluid that has been expelled from the at least one nozzle in the selected sector decreases along the upward flow direction of the drilling fluid. This causes the flow velocity of the drilling fluid to gradually increase along the upward flow direction of the drilling fluid, in order to preserve the (volumetric) flow rate.

Figure 1:
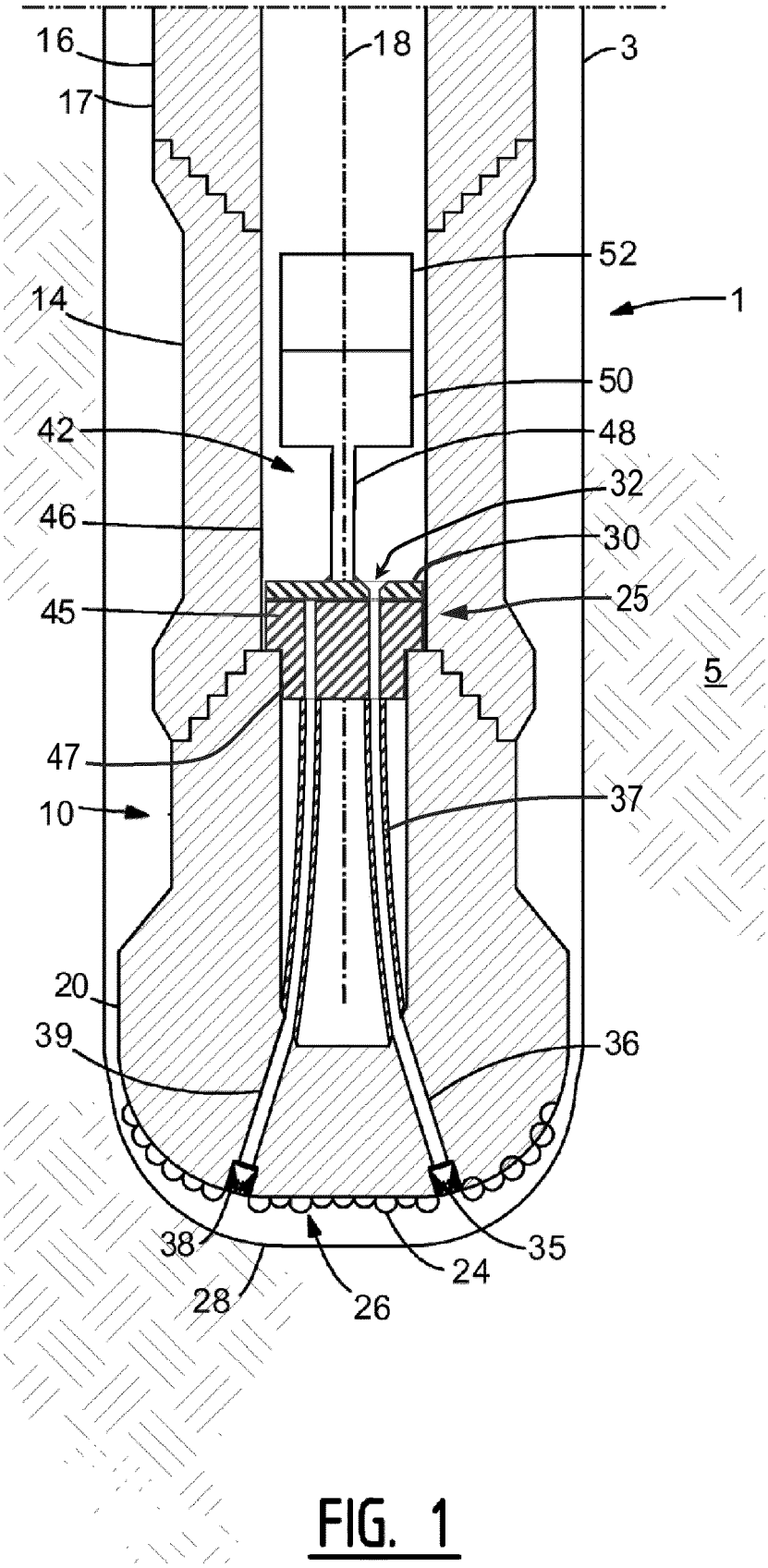
FIG. 1 schematically shows a rotary steerable drill string for directional drilling a borehole in an earth formation.

FIG. 1 shows an embodiment of a rotary steerable system 1 for directional drilling a borehole 3 in an earth formation 5, in which the invention may be implemented. The system 1 comprises a drill bit 10 connected to a lower end of a drill string 16. The drill bit 10 in this example is connected to a sub 14, which is a part of the drill string 16. The drill string 16 may extend to surface. A relatively heavy drill collar section 17 may optionally be included in the downhole end section of the drill string, and is shown connected to the upper end of sub 14. The drill string may be made up of interconnected pipe sections or similar drill string elements.

The longitudinal axis of drill string 16 as well as drill bit 10 is indicated by dot-dashed line 18. The drill string 16 is rotatable about a drill string longitudinal axis 18. The direction of this rotation is azimuthal. The drill bit 10 is connected to the drill string 16 in a rotation-locked configuration. It rotates in unison with the drill string 16 about the longitudinal axis 18 at a drill string rotational frequency within the earth formation 5 (taking the earth formation 5 as the frame of reference).

A drilling fluid passage 46 is available within the drill string 16. A drilling fluid may be passed from an upper end of the drill string to the lower end of the drill string 16 via the drilling fluid passage 46. The drilling fluid passage 46 may be defined by a bore within the drill string 16.

The drill bit 10 is a fixed cutter drill bit, which comprises a bit body 20 provided with fixed cutter elements 24. These fixed cutter elements may be polycrystalline diamond compact cutters (PDC). The cutters at the downward-facing base surface of the drill bit form a bit face 26. During operation, said bit face is positioned near the borehole bottom 28 and facing said borehole bottom 28. Typically, the bit face 26 is in close contact with the borehole bottom 28.

A geostationary platform 42 may be arranged in the sub 14. The geostationary platform 42 is indicated very schematically, as the invention described herein is not limited to any specific embodiment of geostationary platform. Reference is made to US patent application publication US 2016/0084011 A1, which describes in detail some examples of such geostationary platforms suitable for use in combination with the present disclosure.

Generally, the geostationary platform 42 is rotatable within the drill string 16 about the longitudinal axis 18 at platform rotational frequency that differs from the drill string rotational frequency. By controlling the platform rotational frequency relative to the drill string rotational frequency, the geostationary platform 42 can rotate at any desired frequency relative to the earth formation 5. The geostationary platform 42 will typically comprise a counter-rotator 50 which rotates in a direction opposite to the drill string 16 rotation. The counter-rotator 50 may be coupled to a co-rotor 52 via a variable torque coupling. By regulating the variable torque, the platform rotational frequency can be controlled to any desired value.

The geostationary platform 42 may further comprise a flow diverter 30 which may be rigidly coupled to the counter-rotator 50 by means of for example an output shaft 48. The flow diverter 30 diverts the flow of drilling fluid to a preselected azimuthal segment within the drill bit 10. The flow diverter 30 typically may comprise an eccentric flow port 32, which can be maintained oriented at a selected azimuth to guide the flow of drilling fluid into the preselected azimuthal segment within the drill bit 10. The geostationary platform 42 is arranged in the sub 14 in such a way that drilling fluid can pass down the interior of the drill string 16 towards the flow diverter 30. The principle of the flow diverter 30, and some embodiments of flow diverters, have been described in US patent publication Nos. 2016/0061019, 2016/0076305, and 2016/0084011, to which reference is made herein.

The geostationary platform 42 may further comprise orientation sensors and/or a control unit adapted to obtain orientation data, such as from external, connected or integrated measurement devices, e.g. MWD devices, and/or via communication with an external data source, e.g. at surface. From actual and desired orientation data for the outlet member it may be determined, which relative rotation of the geostationary platform 42 with respect to the drill string 16 is needed.

The drill bit 10 is typically provided with a plurality of inlet channels to nozzles, for guiding drilling fluid from the drilling fluid passage 46 to the nozzles, via which the drilling fluid can be expelled into the borehole 3. In FIG. 1, for example, a first nozzle 35 is fed via a first inlet channel 36, and a second nozzle 38 via second inlet channel 39. The first and second nozzles are arranged at different azimuthal positions with respect to the longitudinal axis 18, in this example 180 degrees apart, as counted with respect to rotation of the drill string 16 along its longitudinal axis 18.

In the example shown in FIG. 1, the flow diverter 30 forms part of a switching device 25. The switching device comprises a manifold block 45 is provided with a number of manifold channels 47. Suitably the number of manifold channels 47 is equal to the number of nozzles in the drill bit 10 that need to be separately fed with drilling fluid. Each one of the manifold channels 47 is exclusively connected to one of the inlet channels to the nozzles, and each inlet channel is exclusively connected to one of the manifold channels 47, suitably via a number of intermediate drilling fluid conduits 37. The manifold block 45 is rotationally locked to the drill bit 10 so that it co-rotates with the drill bit 10 and the drill string 16. The manifold channels 47 are provided in a circular band centered on the longitudinal axis 18, on a radius that aligns with the eccentricity of the eccentric flow port 32 in the flow diverter 30. This way, upon rotation of the manifold block 45 in relation to the flow diverter, the eccentric flow port 32 in the flow diverter 30 repetitively aligns with each of the manifold channels 47 in turn, thereby only passing drilling fluid from the drilling fluid passage 46 to the manifold channel 47 that aligns with the eccentric flow port 32 in the flow diverter 30.

It will be appreciated that the manifold block 45 and the associated intermediate drilling fluid conduits 37 can be embodied in the form of an insert which can be slid inside a central bore in the drill bit 10. Alternatively, the manifold block 45 and/or the intermediate drilling fluid conduits 37 could be integral to the drill bit 10 (e.g. drilled bores, or channel structures in a cast bit body 20).

In the specific schematic example shown in FIG. 1, in the configuration as shown the first inlet channel 36 to first nozzle 35 will be in fluid communication with the drilling fluid passage 46 while the second inlet channel 39 to the second nozzle 38 will be blocked. When the drill string 16 has rotated by 180 degrees relative to the earth formation 5, and the flow diverter 30 remains geostationary (not rotating) relative to the earth formation 5, then the second inlet channel 39 to second nozzle 38 will be in fluid communication with the drilling fluid passage 46 while the first inlet channel 36 to the first nozzle 35 will be blocked.

Obviously, if desired three or more nozzles and corresponding manifold channels 47 may be provided at smaller azimuthal intervals (e.g. 120 degrees or 90 degrees). Furthermore, it is conceived that groups of nozzles within an azimuthal segment on the bit face 26 may be connected to a single manifold channel 47 in parallel. In such a case, the bit face 26 could for example comprise two opposing groups of two or more nozzles, or three groups of two or more nozzles.

The system as described in reference to FIG. 1 so far is in essence not much different from the system as described in US patent publication Nos. 2016/0061019, 2016/0076305, and 2016/0084011 and it can work with almost any type of drill bit. For directional drilling, the geostationary platform 42, including the flow diverter 30, will be kept geostationary. The flow diverter 30, specifically the eccentric flow port 32 provided therein, directs the flow of drilling fluid continuously in one azimuthal segment within of the borehole 3, thus creating an underpressure within the borehole 3 and thereby imposing a curve in the trajectory of the borehole 3 towards the segment of underpressure. For drilling in a straight direction, the geostationary platform 42 can be made to either rotate together with the drill string 16 or rotate at any desired non-zero frequency relative to the earth formation 5. In either way, the drilling fluid flow out of the flow diverter 30 sequentially flushes all sides the borehole thereby blurring any preferential deviation of the borehole trajectory.

The local, and potentially geostationary, area of underpressure causes a deviating force exercised by the drill bit to the earth formation. A benefit is that the force is generated locally at the drill bit surface and the side-ways (transversely) directed force does not have to be imposed to the drill bit from some location on the bottom hole assembly located uphole relative to the drill bit.

It has now been found that the local underpressure can be enhanced and/or tailored to needs by an appropriate drill bit design. In the drill bit 10 as shown in FIG. 1 the cutter elements 24 are mounted directly on the bit body 20. The nozzles 35,38 are set in the same base surface as the cutter elements 24. Instead of this drill bit 10, an optimized drill bit is proposed that has an exterior design with specific features to enhance and/or tailor the local underpressure within the borehole 3. The interior design may be the same as described above. The proposed drill bit, described hereinbelow and with reference to FIGS. 2 and 3, can replace drill bit 10 and is specifically optimized for use in the rotary steerable drill string for improved utilization of local underpressure in the borehole.

Figure 2:
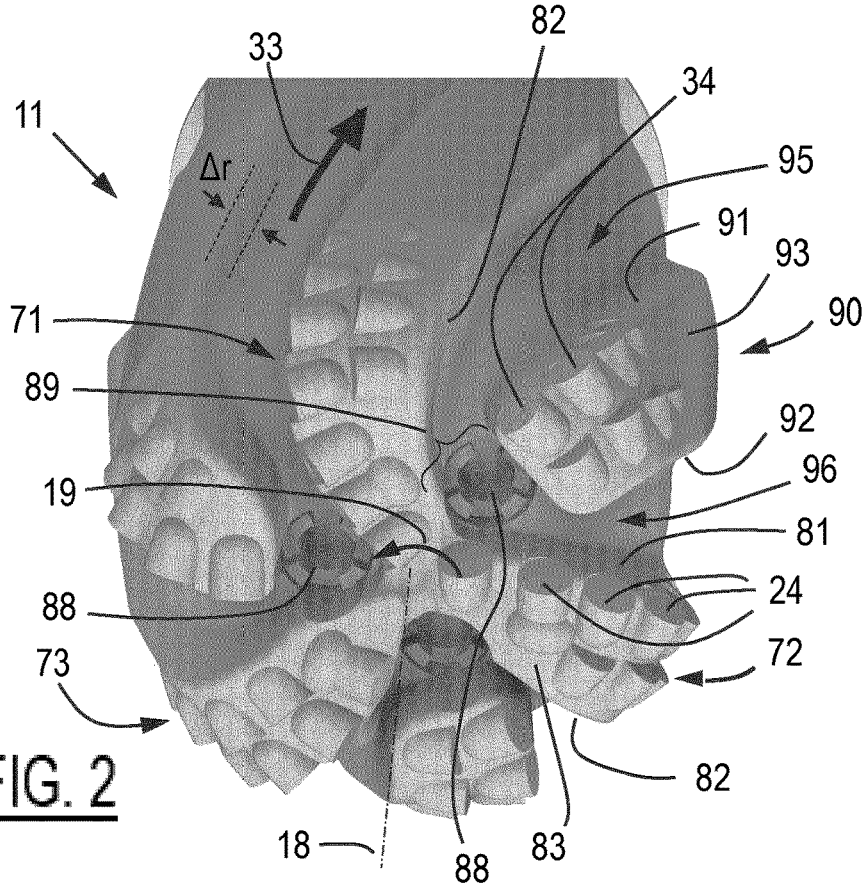
FIG. 2 schematically shows a perspective view on an example drill bit for use on the rotary steerable drill string.
Figure 3:
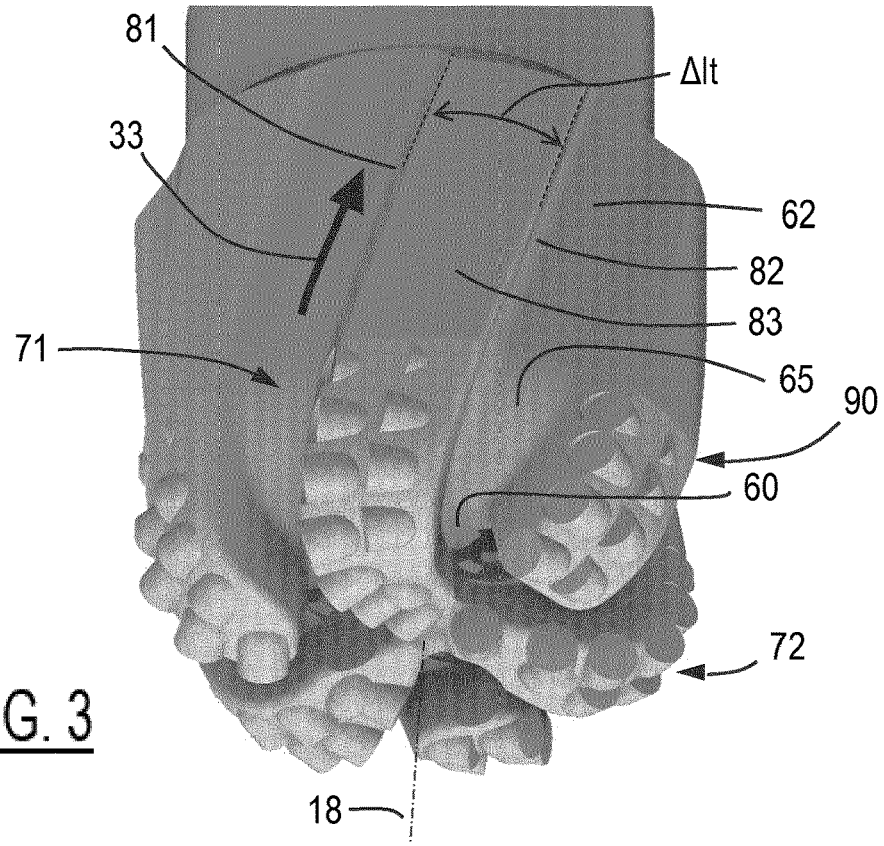
FIG. 3 schematically shows another perspective view on the same example drill bit as shown in FIG. 2 but viewed from a different vantage point.

FIGS. 2 and 3 show an example drill bit 11, from two different vantage points, of which the external design features will be discussed hereinafter. These external design features can be employed in the combination as shown, or individually, or in different combinations with other design features with in the spirit of the present disclosure.

The example drill bit 11 has bit body comprising a base surface 60 facing in a down-facing direction along the longitudinal axis 18. In a borehole, the bottom of the borehole is considered "down" and the surface end of the borehole is considered "up", regardless of the actual trajectory of the borehole. The base surface 60 generally extends transverse to the longitudinal axis 18. The bit body further comprises a barrel surface 62, which circumferences the longitudinal axis 18. The barrel surface 62 generally faces radially outward perpendicular to the longitudinal axis 18 (the barrel surface 62 could for example be a cylindrical surface section). Usually, there may be a smooth transition zone 65 connecting the base surface 60 with the barrel surface 62 where the base surface 60 transitions into the barrel surface 62.

The drill bit 11 further comprises at least two main blades (71,72) protruding from the base surface 60 and from the barrel surface 62. These main blades may be oriented with a spacing of 180 degrees when there are exclusively two main blades. In the example shown in FIGS. 2 and 3, there a third main blade 73, and the exclusively three main blades are oriented with a spacing of 120 degrees between neighboring main blades. Each of the main blades has a leading face 81 facing the azimuthal rotation direction (indicated by arrow 19); a trailing face 82 looking away from the azimuthal rotation direction; and an outer blade surface 83 bridging the leading face 81 and the trailing face 82. The fixed cutter elements 24 are mounted on at least the leading face of each of the main blades. The outer blade surfaces 83 are typically in close contact with the side wall of the borehole 3.

The main blades 71,72,73 . . . divide the base surface 60, the barrel surface 62 and the transition zone 65 into sectors. In each sector at least drilling fluid nozzle 88 is provided in the base surface 60. These drilling fluid nozzles co-rotate with the drill bit, similar to first and second nozzles discussed in FIG. 1.

The main blades 71,72,73 contact each other in the center on the longitudinal axis 18. This means that the leading face 81 of one of the main blades (e.g. the second main blade 72) converges with the trailing face 82 of another of the main blades (e.g. of the first main blade 71). Also, the trailing face 82 of said one of the main blades (e.g. the second main blade 72) converges with the leading face of another of the main blades. This can be the first main blade 71, in case there are two main blades, but it could also be a third main blade 73 in case there are more than two main blades. Converging in this context means that a continuous path can be envisaged that directly goes from the leading face of one of the main blades to the trailing face of an adjacent main blade without traversing the base surface or some other surface. Similarly, the outer blade surfaces 83 of all of the main blades converge at the center of the drill bit face, so that another continuous path can be envisaged that directly goes from the outer blade surface of one of the main blades to any other outer blade surface of any other main blade without traversing the base surface or some other surface of the drill bit 11.

As a result, the drill bit 11 has a fully closed center at the intersection of bit face and the longitudinal axis 18 so that cross flow of drilling fluid that has been expelled from one drilling fluid nozzle 88 in one of the sectors to another sector is hampered. Consequently, the drilling fluid that has been expelled from one drilling fluid nozzle can hardly redistribute itself over the other sectors and instead is forced to flow upward through the same sector as that it was expelled in, at a higher velocity than what would have been the case if the drilling fluid could distribute itself over the other sectors as well. The higher velocity will enhance the local underpressure in this sector.

The drill bit 11 may further comprises at least one auxiliary blade 90 arranged within each sector. The auxiliary blades 90 protrude at least from the barrel surface 62, and (similar to the main blades) each auxiliary blade has an auxiliary leading face 91 facing the azimuthal rotation direction 19; an auxiliary trailing face 92 looking away from the azimuthal rotation direction 19; and an auxiliary outer blade surface 93 bridging the auxiliary leading face 91 and the auxiliary trailing face 92. Preferably, fixed auxiliary cutting elements 34 are mounted at least on the auxiliary leading face 91 on each auxiliary blade 90. Similar to the cutting elements 24 on the main blades, these may be PDC cutters.

An auxiliary blade 90 distinguishes itself from a main blade in that a drilling fluid gap 89 is provided between the auxiliary blade 90 and the center. As a result, there can be fluid communication between the drilling fluid nozzle 88 and a first junk slot 95 defined between the trailing face 82 of one of the two main blades (e.g. the first main blade 71) and the auxiliary leading face 91, as well as fluid communication between the drilling fluid nozzle 88 and a second junk slot 96 defined between the auxiliary trailing face 92 and the leading face 81 of the neighboring main blades that defines the sector in which the auxiliary blade is located (e.g. the second main blade 72). The auxiliary main blade 90 thus further narrows the space available for the upward flow of the drilling fluid in the sector thereby further driving up the flow velocity.

Junk slots, such as first and second junk slots 95,96, are generally provided on the barrel surface 62 to provide a flow channel having an effective aperture for upward flow of drilling fluid that has been expelled from the drilling fluid nozzle 88. The underpressure can be further enhanced if the effective aperture decreases along the upward flow direction 33 of the drilling fluid, forcing the drilling fluid velocity to increase in order to pass the expelled volumetric rate. The junk slot may be shaped to converge, as opposed to conventional bit designs where the junk slot diverges. Additionally, or instead thereof, the depth of the junk slot may be reduced to contribute to maintaining the velocity and under pressure profile.

This can be achieved for instance by employing a slightly (frustro) conical barrel surface which is outwardly tapered (i.e. the outer diameter of the barrel surface increases along an upward direction), which will result in a decreasing radial distance $\Delta r$ between a selected outer blade surface 83 and/or auxiliary outer blade surface 93 on one hand and said barrel surface 62 on the other hand when comparing said radial distance in successive locations in the upward flow direction 33 of the drilling fluid.

Alternatively, or in addition thereto, the circumferential distance $\Delta lt$ between the leading face 81 and the trailing face 82 of a selected main blade (e.g. 71) across the outer blade surface 83 may be diverging along the upward flow direction of the drilling fluid in the junk slots. In addition thereto, or instead thereof, the circumferential distance between the leading face 91 and the trailing face 92 of a selected auxiliary blade 90 across the auxiliary outer blade surface 93 may be diverging along the upward flow direction. Either way, it can be achieved that junk slots formed on the barrel surface 62 between two successively adjacent main and/or auxiliary blades converges in an upward flow direction of the drilling fluid.

In any of these examples, the shape of the junk slot is designed such that the flow velocity of drilling fluid through the junk slot remains high and sustained over a distance. Keeping the velocity high, and consequently the pressure low, may provide larger steering forces as the desired pressure acts over a larger area.

The junk slot profile may be optimized to maximize both the under pressure and exposed area. Computational fluid dynamics models have been made of the closed center of the drill bit, which clearly confirm the resulting effect of isolating the underpressure to the flow area within a single sector of the drill bit. When the drill bit engages into the formation, the closed area at the center of the drill bit effectively contains the underpressure at the point of flow. The models also shows the underpressure is reducing as the flow slows down in the transition zone between the base surface and the barrel surface.

A further benefit that can be drawn from the present disclosure, is that it offers a degree of control over how the deviating force that is exercised by the drill bit on the earth formation is directed from the drill bit to the earth formation. This can be achieved by tailoring the underpressure profile along the drill bit using the drilling fluid flow influencing methodologies described above. For example, if the underpressure profile shows the region of highest underpressure is underneath the bit face, then the deviating force is expected to be directed at an angle of generally less than 45°, or possibly even less than 30°, from the forward drilling direction along the longitudinal axis through the drill bit. However, if the region of highest underpressure is brought up more towards or onto the barrel surface, then the angle of the direction of the deviating force relative to the forward drilling direction will increase accordingly, and could even exceed 30° or preferably exceed 45°. Thus, the drill bit design can be tailored to a desired target build rate.

The computational fluid dynamics model used for the drill bit of FIGS. 2-3 showed the region of the highest underpressure was underneath the bit face, in the narrowest part of the flow channels between the auxiliary blade and the main blades. With this drill bit a 6.0" hole (about 15 cm) was drilled in granite rock at a build rate of around 8°/30 m. A typical build rate for this drill bit is expected to lie 8°/30 m and 10°/30 m. By further tailoring the design and moving up the region of highest underpressure, a build rate exceeding 10°/30 m may be achieved, for example in the range of between 10°/30 m and 20°/30 m.

The person skilled in the art will understand that the teachings described in the present paper can be applied to advantageously modify any of the embodiments described in US patent publication Nos. 2016/0061019, 2016/0076305, and 2016/0084011; all of which are incorporated herein by reference.

The person skilled in the art will understand that the present invention can be carried out in many various ways without departing from the scope of the appended claims.

That which is claimed is:

1. A rotary steerable drill string, comprising:

a drill string rotatable in an azimuthal direction about a drill string longitudinal axis;

a drill bit connected to a lower end of the drill string in a rotation-locked configuration to rotate in unison with the drill string about the drill string longitudinal axis within a borehole in an earth formation;

a drilling fluid passage within the drill string, to pass a drilling fluid from an upper end of the drill string to the lower end of the drill string via the drilling fluid passage;

a flow diverter configured in a lower end of the drill string in the drilling fluid passage, wherein the flow diverter is configured to be rotatable about the drill string longitudinal axis relative to the drill string, to preferentially direct the drilling fluid from the drilling fluid passage into an azimuth segment which is stationary relative to the flow diverter;

wherein the drill bit has a base surface facing in a down-facing direction along the longitudinal axis, and a barrel surface circumferencing the longitudinal axis and facing radially outward perpendicular to the longitudinal axis, the drill bit comprising at least two main blades protruding from the base surface and from the barrel surface, and each of the two main blades having a leading face facing the azimuthal rotation direction and a trailing face looking away from the azimuthal rotation direction and an outer blade surface bridging the leading face and the trailing face, and a plurality of fixed cutter elements mounted on at least the leading face of each of the two main blades, wherein the drill bit has a fully closed center at the intersection of bit face and the longitudinal axis, wherein the at least two main blades contact each other, whereby the leading face of one of the two main blades converges with the trailing face of another of the at least two main blades and the trailing face of said one of the two main blades converges with the leading face of said other of the at least two main blades, and wherein in each sector of the bit face defined by and bound between two adjacent main blades is provided with at least drilling fluid nozzle which co-rotates with the drill bit, and wherein at least one junk slot is provided on the barrel surface to provide a flow channel having an effective aperture for upward flow of drilling fluid that has been expelled from the at least one nozzle, which effective aperture decreases along the upward flow direction of the drilling fluid wherein a circumferential width of the flow channel converges when considered at successive locations along the upward flow direction.

2. The rotary steerable drill string of claim 1, wherein the drill bit further comprises at least one auxiliary blade arranged within each sector and protruding at least from the barrel surface, which auxiliary blade comprises an auxiliary leading face facing the azimuthal rotation direction and an auxiliary trailing face looking away from the azimuthal rotation direction and an auxiliary outer blade surface bridging the auxiliary leading face and the auxiliary trailing face, and a drilling fluid gap is provided between the auxiliary blade and the center.

3. The rotary steerable drill string of claim 2, wherein during drilling there is fluid communication between the at least one drilling fluid nozzle and a first junk slot defined between the trailing face of said one of the two main blades and the auxiliary leading face and between the at least one drilling fluid nozzle and a second junk slot defined between the auxiliary trailing face and the leading face of said other of the at least two main blades.

4. The rotary steerable drill string of claim 2, wherein a plurality of fixed auxiliary cutter elements is mounted on at least the auxiliary leading face of the at least one auxiliary blade.

5. The rotary steerable drill string of claim 1 wherein the fixed cutter elements and/or the fixed auxiliary cutter elements are polycrystalline diamond (PCD) cutters.

6. The rotary steerable drill string of claim 1, wherein a circumferential distance between the leading face and the trailing face of a selected main blade is diverging along the upward flow direction of the drilling fluid.

7. The rotary steerable drill string of claim 1, wherein a circumferential distance between an auxiliary leading face and auxiliary trailing face of a selected auxiliary blade across the auxiliary outer blade surface is diverging along the upward flow direction of the drilling fluid.

8. The rotary steerable drill string of claim 1, wherein an outer diameter of the barrel surface increases along an upward flow direction of the drilling fluid.

9. A method of rotary steerable drilling through an earth formation, comprising:

rotating a drill string in an azimuthal direction about a drill string longitudinal axis;

rotating a drill bit within a borehole in the earth formation, which drill bit is connected to a lower end of the drill string in a rotation-locked configuration, in unison with the drill string about the drill string longitudinal axis, wherein the drill bit has a base surface facing in a down-facing direction along the longitudinal axis, and a barrel surface circumferencing the longitudinal axis and facing radially outward perpendicular to the longitudinal axis, with at least two drilling fluid nozzles provided in the down-facing direction which co-rotates with the drill bit;

passing a drilling fluid from an upper end of the drill string to the lower end of the drill string via a drilling fluid passage within the drill string;

with a flow diverter configured in a lower end of the drill string in the drilling fluid passage, preferentially directing the drilling fluid from the drilling fluid passage into an azimuth segment which is stationary relative to the flow diverter, while rotating the flow diverter about the drill string longitudinal axis relative to the drill string whereby at least one of drilling fluid nozzle moves through the azimuth segment while another nozzle is on an opposing side whereby the drilling fluid is expelled more through the at least one nozzle that moves through the azimuth segment than through the nozzle that is on said opposing side;

creating an underpressure as a result of the expelling of the drilling fluid in the azimuth segment relative to an opposing azimuthal section, thereby causing a deviating force exercised by the drill bit to the earth formation;

enhancing the underpressure by selecting the drill bit to comprise at least two main blades protruding from the base surface and from the barrel surface, and each of the two main blades having a leading face facing the azimuthal rotation direction and a trailing face looking away from the azimuthal rotation direction and an outer blade surface bridging the leading face and the trailing face, and a plurality of fixed cutter elements mounted on at least the leading face of each of the two main blades, wherein the drill bit has a fully closed center at the intersection of bit face and the longitudinal axis, wherein the at least two main blades contact each other, whereby the leading face of one of the two main blades converges with the trailing face of another of the at least two main blades and the trailing face of said one of the two main blades converges with the leading face of said other of the at least two main blades, and wherein in each sector of the bit face defined by and bound between two adjacent main blades is provided with at least one drilling fluid nozzle which co-rotates with the drill bit, and wherein at least one junk slot is provided on the barrel surface to provide a flow channel having an effective aperture for upward flow of drilling fluid that has been expelled from the at least one nozzle, which effective aperture decreases along the upward flow direction of the drilling fluid wherein a circumferential width of the flow channel converges when considered at successive locations along the upward flow direction.

10. The method of claim 9, wherein said effective aperture decreases causes a flow velocity of the drilling fluid to increase along the upward flow of the drilling fluid.

11. The method of claim 9, wherein a circumferential distance between the leading face and the trailing face of a selected main blade is diverging along the upward flow direction of the drilling fluid.

12. The method of claim 9, wherein a circumferential distance between an auxiliary leading face and auxiliary trailing face of a selected auxiliary blade across the auxiliary outer blade surface is diverging along the upward flow direction of the drilling fluid.

13. The method of claim 9, wherein an outer diameter of the barrel surface increases along an upward flow direction of the drilling fluid.

14. The method of claim 9, wherein the outer blade surface is in close contact with a side wall of the borehole.

15. A rotary steerable drill string, comprising:

a drill string rotatable in an azimuthal direction about a drill string longitudinal axis;

a drill bit connected to a lower end of the drill string in a rotation-locked configuration to rotate in unison with the drill string about the drill string longitudinal axis within a borehole in an earth formation;

a drilling fluid passage within the drill string, to pass a drilling fluid from an upper end of the drill string to the lower end of the drill string via the drilling fluid passage;

a flow diverter configured in a lower end of the drill string in the drilling fluid passage, wherein the flow diverter is configured to be rotatable about the drill string longitudinal axis relative to the drill string, to preferentially direct the drilling fluid from the drilling fluid passage into an azimuth segment which is stationary relative to the flow diverter;

wherein the drill bit has a base surface facing in a down-facing direction along the longitudinal axis, and a barrel surface circumferencing the longitudinal axis and facing radially outward perpendicular to the longitudinal axis, the drill bit comprising at least two main blades protruding from the base surface and from the barrel surface, and each of the two main blades having a leading face facing the azimuthal rotation direction and a trailing face looking away from the azimuthal rotation direction and an outer blade surface bridging the leading face and the trailing face, and a plurality of fixed cutter elements mounted on at least the leading face of each of the two main blades, wherein the drill bit has a fully closed center at the intersection of bit face and the longitudinal axis, wherein the at least two main blades contact each other, whereby the leading face of one of the two main blades converges with the trailing face of another of the at least two main blades and the trailing face of said one of the two main blades converges with the leading face of said other of the at least two main blades, and wherein in each sector of the bit face defined by and bound between two adjacent main blades is provided with at least drilling fluid nozzle which co-rotates with the drill bit, and wherein at least one junk slot is provided on the barrel surface to provide a flow channel having an effective aperture for upward flow of drilling fluid that has been expelled from the at least one nozzle, which effective aperture decreases along the upward flow direction of the drilling fluid wherein an outer diameter of the barrel surface increases along an upward flow direction of the drilling fluid.

16. A method of rotary steerable drilling through an earth formation, comprising:

rotating a drill string in an azimuthal direction about a drill string longitudinal axis;

rotating a drill bit within a borehole in the earth formation, which drill bit is connected to a lower end of the drill string in a rotation-locked configuration, in unison with the drill string about the drill string longitudinal axis, wherein the drill bit has a base surface facing in a down-facing direction along the longitudinal axis, and a barrel surface circumferencing the longitudinal axis and facing radially outward perpendicular to the longitudinal axis, with at least two drilling fluid nozzles provided in the down-facing direction which co-rotates with the drill bit;

passing a drilling fluid from an upper end of the drill string to the lower end of the drill string via a drilling fluid passage within the drill string;

with a flow diverter configured in a lower end of the drill string in the drilling fluid passage, preferentially directing the drilling fluid from the drilling fluid passage into an azimuth segment which is stationary relative to the flow diverter, while rotating the flow diverter about the drill string longitudinal axis relative to the drill string whereby at least one of drilling fluid nozzle moves through the azimuth segment while another nozzle is on an opposing side whereby the drilling fluid is expelled more through the at least one nozzle that moves through the azimuth segment than through the nozzle that is on said opposing side;

creating an underpressure as a result of the expelling of the drilling fluid in the azimuth segment relative to an opposing azimuthal section, thereby causing a deviating force exercised by the drill bit to the earth formation;

enhancing the underpressure by selecting the drill bit to comprise at least two main blades protruding from the base surface and from the barrel surface, and each of the two main blades having a leading face facing the azimuthal rotation direction and a trailing face looking away from the azimuthal rotation direction and an outer blade surface bridging the leading face and the trailing face, and a plurality of fixed cutter elements mounted on at least the leading face of each of the two main blades, wherein the drill bit has a fully closed center at the intersection of bit face and the longitudinal axis, wherein the at least two main blades contact each other, whereby the leading face of one of the two main blades converges with the trailing face of another of the at least two main blades and the trailing face of said one of the two main blades converges with the leading face of said other of the at least two main blades, and wherein in each sector of the bit face defined by and bound between two adjacent main blades is provided with at least one drilling fluid nozzle which co-rotates with the drill bit, and wherein at least one junk slot is provided on the barrel surface to provide a flow channel having an effective aperture for upward flow of drilling fluid that has been expelled from the at least one nozzle, which effective aperture decreases along the upward flow direction of the drilling fluid wherein an outer diameter of the barrel surface increases along an upward flow direction of the drilling fluid.

17. The method of claim 16, wherein said effective aperture decreases causes a flow velocity of the drilling fluid to increase along the upward flow of the drilling fluid.

18. The method of claim 16, wherein the outer blade surface is in close contact with a side wall of the borehole.

* * * * *